US009511588B2

(12) United States Patent
Minami et al.

(10) Patent No.: US 9,511,588 B2
(45) Date of Patent: Dec. 6, 2016

(54) METHOD FOR PROCESSING SILICON SUBSTRATE

(71) Applicant: CANON KABUSHIKI KAISHA, Tokyo (JP)

(72) Inventors: Seiko Minami, Warabi (JP); Toshiyasu Sakai, Kawasaki (JP); Masataka Kato, Hiratsuka (JP); Masaya Uyama, Kawasaki (JP); Hiroshi Higuchi, Atsugi (JP); Yoshinao Ogata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 26 days.

(21) Appl. No.: 14/518,946

(22) Filed: Oct. 20, 2014

(65) Prior Publication Data

US 2015/0111321 A1 Apr. 23, 2015

(30) Foreign Application Priority Data

Oct. 22, 2013 (JP) ..... 2013-219641

(51) Int. Cl.
*B41J 2/16* (2006.01)

(52) U.S. Cl.
CPC ..... *B41J 2/1648* (2013.01); *B41J 2/1603* (2013.01); *B41J 2/1623* (2013.01); *B41J 2/1628* (2013.01); *B41J 2/1629* (2013.01); *B41J 2/1631* (2013.01)

(58) Field of Classification Search
CPC ..... B41J 2/1626; B41J 2/1635; B41J 2/1623; B41J 2/1628; B41J 2/1629; B41J 2/1639; H01L 21/6836
See application file for complete search history.

(56) References Cited

U.S. PATENT DOCUMENTS 7,481,943 B2 1/2009 McAvoy
7,488,539 B2 * 2/2009 Kozakai ..... C09J 7/0207 428/447
7,575,298 B2 * 8/2009 Silverbrook ..... B41J 2/1412 347/40
7,607,227 B2 * 10/2009 Vaeth ..... B41J 2/16 216/42
8,205,339 B2 * 6/2012 Sakashita ..... B41J 2/16 29/890.1
8,302,308 B2 * 11/2012 Vaeth ..... B41J 2/16 29/890.1
8,585,913 B2 * 11/2013 Vaeth ..... B41J 2/1433 216/27
8,920,662 B2 * 12/2014 Takeuchi ..... B41J 2/162 216/17

(Continued)

*Primary Examiner* — Fernando L Toledo
*Assistant Examiner* — Christine L Hagan
(74) *Attorney, Agent, or Firm* — Canon U.S.A., Inc. IP Division

(57) ABSTRACT

A method for processing a silicon substrate, comprising the steps of providing a silicon substrate having a first surface and a second surface, forming a non-penetrated hole extending from the first surface toward the second surface side in the silicon substrate, sticking a sealing tape comprising a support member and an adhesive layer on the first surface and filling at least part of the non-penetrated hole with the adhesive layer, performing reactive ion etching from the second surface toward the first surface side to allow the reactive ion etching to reach the adhesive layer filled in the non-penetrated hole and to expose the adhesive layer, and peeling the sealing tape from the silicon substrate to form a through hole in the silicon substrate.

17 Claims, 7 Drawing Sheets

(56) References Cited

U.S. PATENT DOCUMENTS

| | | | | |
|---|---|---|---|---|
| 2003/0052947 | A1* | 3/2003 | Lin | B41J 2/1404<br>347/63 |
| 2007/0090299 | A1* | 4/2007 | Kozakai | C09J 7/0207<br>250/370.01 |
| 2007/0153053 | A1* | 7/2007 | Back | B41J 2/1433<br>347/45 |
| 2007/0200877 | A1* | 8/2007 | Arakawa | B41J 2/16<br>347/1 |
| 2009/0011158 | A1* | 1/2009 | Yeshurun | A61M 37/0015<br>428/34.1 |
| 2009/0212008 | A1* | 8/2009 | Uyama | B41J 2/14145<br>216/27 |
| 2012/0293584 | A1* | 11/2012 | Fang | B41J 2/1404<br>347/44 |

* cited by examiner

METHOD FOR PROCESSING SILICON SUBSTRATE

BACKGROUND

Field of the Invention

The present disclosure relates to a method for processing a silicon substrate.

Description of the Related Art

A method by using reactive ion etching, which is one type of dry etching, is mentioned as a method for forming a through hole in a silicon substrate. The processing of the silicon substrate by using the reactive ion etching is a method in which the through hole is formed in the silicon substrate by using an etching gas. In particular, in the case where a liquid supply port serving as a through hole is formed in the silicon substrate used for a liquid ejection head typified by an inkjet head, the reactive ion etching can be used. According to the reactive ion etching, a hole having a vertical shape is formed easily, so that the through hole does not widen laterally easily and the size of the silicon substrate is decreased.

Two methods, single-sided processing and double-sided processing, are mentioned as processing methods to form the through hole in the silicon substrate by reactive ion etching. One surface of the silicon substrate is specified to be a first surface and the other surface is specified to be a second surface which is a surface opposite to the first surface. At this time, in the case of the single-sided processing, etching is started from the first surface of the silicon substrate, and the etching is continued until the second surface of the silicon substrate is reached, so that the silicon substrate is penetrated. On the other hand, in the case of the double-sided processing, etching is started from, for example, the first surface of the silicon substrate, and the etching is stopped in midstream. Consequently, a non-penetrated hole extending from the first surface toward the second surface side is formed in the silicon substrate. Subsequently, etching is performed from the second surface on the opposite side toward the first surface side, and etching is allowed to reach the non-penetrated hole. As a result, the silicon substrate is penetrated. According to the double-sided processing, the shape of the through hole is controlled easily and even a through hole having a complicated shape, for example, a shape in which the width is changed at some midpoint, is formed easily.

In the case where the silicon substrate is processed by the reactive ion etching, a phenomenon called over etching may occur. In the double-sided processing, when the reactive ion etching is performed from the second surface and the silicon substrate is penetrated, as described above, there is no target of etching in the etching direction (the extension direction of hole) and a hole is formed in the direction perpendicular to the extension direction of the hole. This is the over etching and the opening on the first surface side of the through hole is widened as compared with the predetermined shape. This state will be specifically described with reference to FIGS. 7A to 7C. FIGS. 7A to 7C show the state of forming a liquid supply port serving as a through hole 11 in a silicon substrate 1. As shown in FIG. 7A, a silicon substrate 1 having a first surface 2 and a second surface 3 which is a surface opposite to the first surface is provided. The silicon substrate 1 has an etching mask 9 on the first surface 2 side. As shown in FIG. 7B, reactive ion etching is performed from the first surface 2 of the silicon substrate 1 through the opening of the etching mask 9. In this manner, a non-penetrated hole 6 is formed in the silicon substrate 1. Then, an etching mask is also formed on the second surface 3 side and reactive ion etching is performed from the second surface 3 side. When etching is allowed to reach the non-penetrated hole 6 and the silicon substrate 1 is penetrated, a through hole 11 is formed as shown in FIG. 7C. If the etching is further continued, a hole 14 which has been widened laterally by over etching is formed on the first surface 2 side of the silicon substrate 1. That is, the opening on the first surface 2 side of the through hole 11 is widened laterally. In the case of the liquid ejection head, the hole formed by the over etching may be widened to a region provided with an energy-generating element or a wiring thereof and the reliability of the liquid ejection head may be degraded. Also, in the case where an object having low electrical conductivity (it may be an insulator) is present in the etching direction when the reactive ion etching is performed, a phenomenon called notching may occur. The notching is also one type of over etching. In the case where the reactive ion etching is performed, usually, an object having low electrical conductivity is present in the etching direction and, therefore, the notching is also one of issues.

U.S. Pat. No. 7,481,943 discloses that a non-penetrated hole is formed from a first surface of a silicon substrate by reactive ion etching and, thereafter, a resin is filled into the non-penetrated hole. In this method, after the resin is filled into the non-penetrated hole, reactive ion etching is performed from a second surface, the etching is allowed to reach the resin, and the resin is removed finally, so that a through hole is formed.

It is considered that according to the method described in U.S. Pat. No. 7,481,943, the position of occurrence of over etching is shifted from the front surface of the substrate to the back surface side and, as a result, lateral widening of the through hole is suppressed.

SUMMARY OF THE INVENTION

The present disclosure provides a method for processing a silicon substrate to form a through hole in the silicon substrate, the method comprising the steps of providing a silicon substrate having a first surface and a second surface which is a surface opposite to the first surface, forming a non-penetrated hole extending from the first surface of the silicon substrate toward the second surface side in the above-described silicon substrate, sticking a sealing tape comprising a support member and an adhesive layer on the first surface of the above-described silicon substrate and filling at least part of the above-described non-penetrated hole with the above-described adhesive layer, performing reactive ion etching from the second surface of the above-described silicon substrate toward the first surface side to allow the above-described reactive ion etching to reach the adhesive layer filled in the non-penetrated hole and to expose the adhesive layer, and peeling the above-described sealing tape from the above-described silicon substrate to form the through hole in the above-described silicon substrate.

Further features of the present invention will become apparent from the following description of exemplary embodiments with reference to the attached drawings.

DESCRIPTION OF THE EMBODIMENTS

According to the studies by the present inventors, in the method described in U.S. Pat. No. 7,481,943, as the non-penetrated hole formed from the first surface side, that is, the hole to be filled with the resin, becomes deeper, the filling of the resin becomes difficult. Furthermore, removal of the resin with a solvent or the like is necessary and, therefore, the number of steps increases correspondingly.

The present disclosure solves at least these issues and provides a method for processing a silicon substrate, where lateral widening of the opening of the through hole due to over etching is suppressed easily even in the case where the through hole is formed by performing double-sided processing of the silicon substrate.

The embodiments according to the present disclosure will be described below with reference to the drawings.

Figure 6:
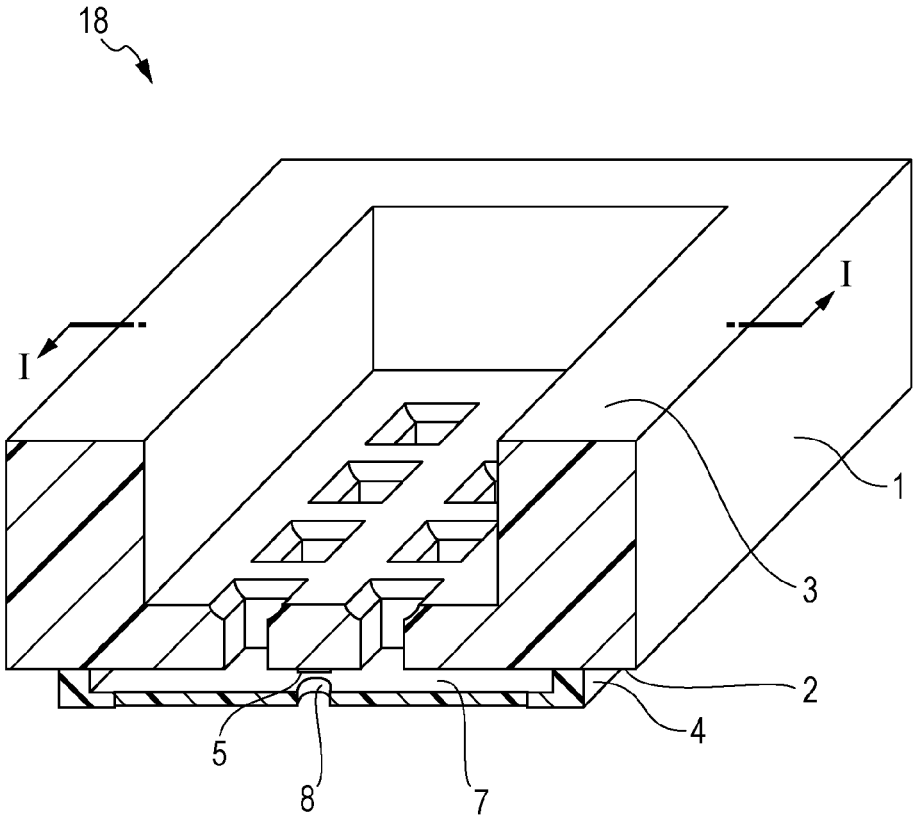
FIG. 6 is a diagram showing an example of a liquid ejection head comprising a silicon substrate processed.
Figure 7A:
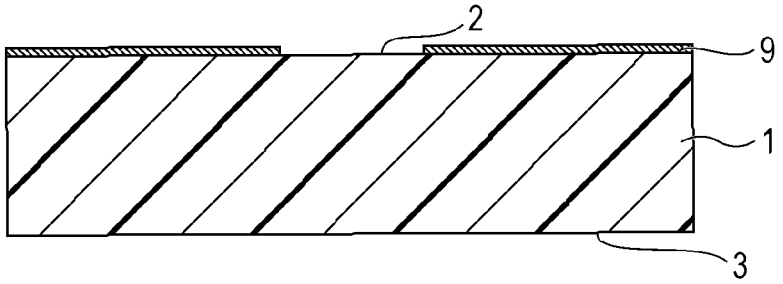
FIGS. 7A to 7C are diagrams showing a method for processing a silicon substrate in the related art.
Figure 7B:
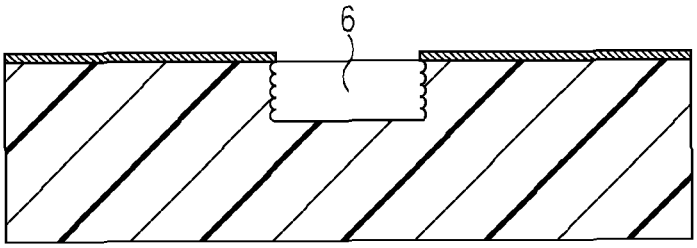
Figure 7C:
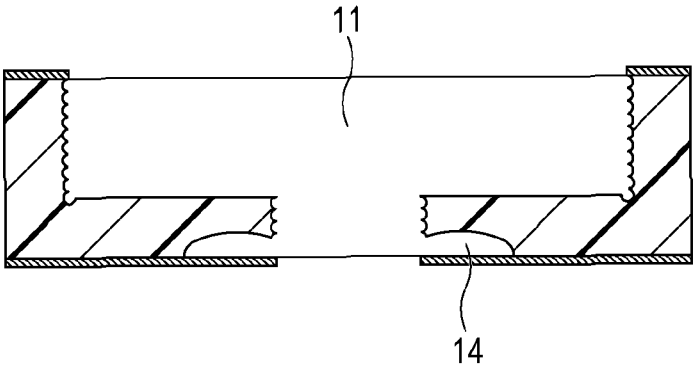

A silicon substrate processed by the method for processing a silicon substrate, according to the present disclosure, is used for various applications. As an example thereof, a silicon substrate for a liquid ejection head is mentioned. FIG. 6 is a diagram showing an example of a liquid ejection head comprising a silicon substrate processed.

As shown in FIG. 6, a liquid ejection head 18 comprises a silicon substrate 1. The silicon substrate 1 has a first surface 2 and a second surface 3 which is a surface opposite to the first surface 2. An energy-generating element 5 is disposed on the first surface 2 side of the silicon substrate 1. Examples of the energy-generating element 5 include a heat generating resistor and a piezoelectric transducer. The energy-generating element 5 may be embedded in the first surface 2 of the silicon substrate 1, be disposed in contact with the first surface 2, or be disposed on the first surface 2 with a member or a space therebetween. A member 4 is disposed on the first surface 2 side of the silicon substrate 1. The member 4 constitutes a liquid flow passage 7 and a liquid ejection port 8 and is formed from, for example, a resin, in particular a negative photosensitive resin, or an inorganic film of SiN, SiC, or the like. A liquid (for example, ink) is supplied to the liquid flow passage 7, and energy is given to the supplied liquid from the energy-generating element 5. As a result, the liquid is ejected from the liquid ejection port 8 and an image or the like is recorded. In FIG. 6, a liquid supply port is formed from a common supply port on the second surface 3 side and a plurality of independent supply ports extending from the common supply port independently. The liquid supply port is a through hole penetrating the silicon substrate 1.

The method for processing the silicon substrate will be described. FIGS. 1A to 1E are diagrams showing a portion corresponding to a cross section of the silicon substrate 1, taken along a line I-I shown in FIG. 6. In FIGS. 1A to 1E, one chip of silicon substrate is shown as an example of the silicon substrate 1, although a silicon wafer formed from a plurality of chips of silicon substrates can be used. The plurality of chips of silicon substrates are obtained from one silicon wafer by cutting (dicing) the one silicon wafer.

Figure 1A:
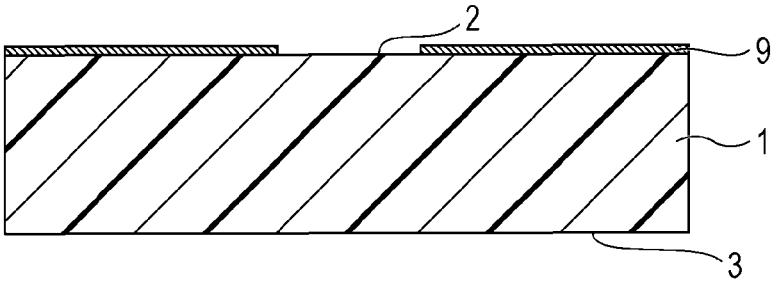
FIGS. 1A to 1E are diagrams showing an example of a method for processing a silicon substrate.

As shown in FIG. 1A, a silicon substrate 1 having the first surface 2 and the second surface 3 which is a surface opposite to the first surface 2 is provided. The silicon substrate 1 comprises an etching mask 9 on the first surface 2 side. The etching mask 9 is formed from, for example, $SiO_2$ or a positive photosensitive resin. An opening is disposed in the etching mask 9. Part of the first surface 2 of the silicon substrate 1 is exposed at the opening.

Figure 1B:
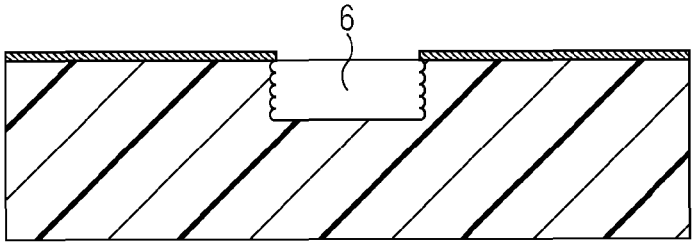

As shown in FIG. 1B, a non-penetrated hole 6 is formed in the silicon substrate 1 by performing processing from the first surface 2 of the silicon substrate 1 through the opening of the etching mask 9. FIG. 1B shows an example in which the non-penetrated hole 6 is formed by performing reactive ion etching from the opening of the etching mask 9. The reactive ion etching is an etching method in which an etching gas is converted to plasma, a high frequency voltage is applied to a negative electrode where an etching object is present and, thereby, ion species and radical species are brought into collision with the etching object. The method for forming the non-penetrated hole 6 is not limited to this. For example, formation may be performed by processing with a laser or wet etching with an etchant. The wet etching can be crystal anisotropic etching. The etching mask 9 is not necessarily disposed. In the case where the non-penetrated hole 6 is formed by the reactive ion etching, the bosch process can be performed, where processes of etching (for example, etching with $SF_6$) and deposition (for example, deposition by using $C_4F_8$) are repeated alternately. The non-penetrated hole 6 has an opening in the first surface and extends from the first surface toward the second surface side.

Figure 1C:
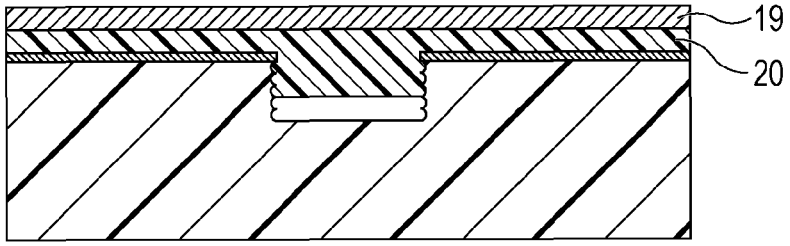

As shown in FIG. 1C, a sealing tape comprising a support member 19 and an adhesive layer 20 is stuck on the first surface 2 of the silicon substrate 1. In addition, at least part of the non-penetrated hole 6 is filled with the adhesive layer 20. In the present disclosure, such a configuration is employed and, thereby, the place of occurrence of over etching is specified to be the position apart from the first surface 2 and the second surface 3 of the silicon substrate 1 correspondingly to the depth of the adhesive layer filled in the non-penetrated hole 6. Also, the sealing tape is stuck and, therefore, at least part of the non-penetrated hole 6 is filled easily, and the adhesive layer 20 is removed from the non-penetrated hole 6 easily.

The support member 19 of the sealing tape may be formed from, for example, polymers, e.g., polyolefin, polyamide, polyester (polyethylene terephthalate/isophthalate copolymer), polyvinyl chloride, and cellulose. The support member 19 can be formed from an electrically conductive material from the viewpoint of suppression of notching. On the other hand, the adhesive layer 20 of the sealing tape can be plastically deformed because at least part of the non-penetrated hole 6 is filled therewith. Also, the susceptibility of the adhesive layer 20 to reactive ion etching can be lower than that of the silicon substrate 1. From these points, the adhesive layer 20 can be formed from a polyvinylphenol resin, a novolac resin, a polyvinyl polyimide resin, an acrylic resin, a polyolefin resin, or the like.

Figure 1D:
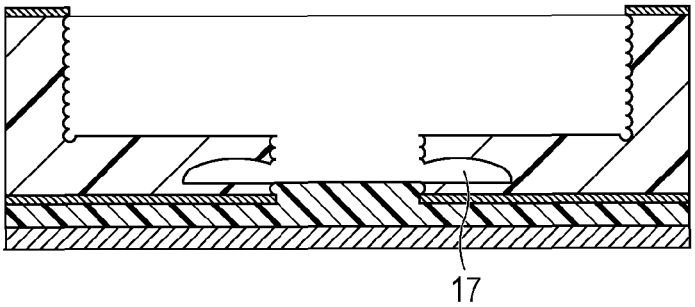

The adhesive layer 20 is filled in at least part of the non-penetrated hole 6. In the following step, when the reactive ion etching reaches the adhesive layer 20, the adhesive layer 20 is etched. At the same time, as shown in FIG. 1D, a hole 17 widened laterally is also formed by over etching. The length of the portion, which is filled in at least part of the non-penetrated hole, of the adhesive layer in the extension direction of the non-penetrated hole can be larger than the length of the hole 17 in the direction perpendicular to the extension direction of the non-penetrated hole. The over etching occurs not only in the direction perpendicular to the extension direction of the non-penetrated hole but also in the other directions. For example, etching may occur isotropically, where starting point is the point at which the over etching occurs. In this case, the over etching occurs in the direction parallel to the extension direction of the non-penetrated hole as well. If the over etching occurs in the direction parallel to the extension direction of the non-penetrated hole, the hole 17 proceeds to the first surface 2 side and finally reaches the first surface 2. Consequently, the opening formed on the first surface 2 side of the silicon substrate is widened laterally. Therefore, design can be performed in such a way that the length of the portion, which is filled in at least part of the non-penetrated hole, of the adhesive layer in the extension direction of the non-penetrated hole becomes larger than the length of the hole 17 in the direction perpendicular to the extension direction of the non-penetrated hole. The production process is required to have some margin and, thereby, the over etching in itself occurs to some extent. In the case where usual over etching is concerned, specifically, the length of the portion, which is filled in at least part of the non-penetrated hole, of the adhesive layer in the extension direction of the non-penetrated hole is specified to be preferably 3.0 μm or more, although depending on the degree of over etching. The length is more preferably 5.0 μm or more, and further preferably 10.0 μm or more. The upper limit is not specifically defined, but in consideration of filling with the adhesive layer of the sealing tape, 100.0 μm or less is preferable.

The adhesive layer 20 can be filled in 90% or more of the non-penetrated hole 6 when the first surface 2 of the silicon substrate 1 is viewed from above, and particularly be filled in the whole non-penetrated hole 6. The term "fill in" does not refer to the state of merely blocking the non-penetrated hole 6 but refers to the state of being entered and present on the non-penetrated hole 6 side (the second surface side) with respect to the first surface 2 in the cross section shown in FIGS. 1A to 1E.

The filling of the adhesive layer 20 into the non-penetrated hole 6 can be performed by a method in which a roller is used and at least the adhesive layer of the sealing tape is heated and is stuck. As the heating temperature increases, the pressurization time may be reduced. The pressure in the sticking can be constant. As for the roller, for example, a roller in which a core is formed from a metal and the outermost surface thereof is covered with rubber may be used. The temperature of the adhesive layer 20 of the sealing tape in the sticking is specified to be preferably 70° C. or higher, and more preferably 80° C. or higher. Meanwhile, 140° C. or lower is preferable, and 130° C. or lower is more preferable. The pressure applied to the sealing tape is preferably 0.1 MPa or more, and more preferably 0.2 MPa or more. Meanwhile, 1.5 MPa or less is preferable, and 1.0 MPa or less is more preferable.

As shown in FIG. 1D, reactive ion etching is performed from the second surface 3 of the silicon substrate 1 toward the first surface 2 side, and the reactive ion etching is allowed to reach the adhesive layer filled in the non-penetrated hole 6, so that the adhesive layer is exposed. The bosch process can be employed as the reactive ion etching performed from the second surface 3. The term "the reactive ion etching reaches the adhesive layer" refers to that the etching gas of the reactive ion etching reaches the adhesive layer. When the adhesive layer is exposed, forming of the hole 17 is started. However, the position at which the hole 17 is formed is a position slightly shifted from the first surface 2 to the second surface 3 side because the non-penetrated hole 6 is filled with the adhesive layer 20.

Figure 1E:
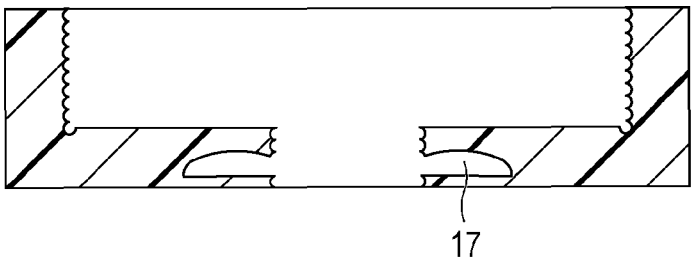

As shown in FIG. 1E, the sealing tape is peeled from the silicon substrate 1. In this manner, a through hole is formed in the silicon substrate 1. The through hole penetrates from the first surface 2 to the second surface 3 of the silicon substrate 1. The adhesive layer 20 hardly remains in the through hole because of peeling of the sealing tape, and the adhesive layer 20 is removed from the through hole easily. It is not necessary to fill almost whole non-penetrated hole with the resin, and lateral widening of the opening of the through hole is suppressed by filling a small amount of adhesive layer into the first surface side. Consequently, it is possible to satisfactorily deal with even a deep through hole.

When the individual chips of silicon substrates 1 are obtained from a silicon wafer, the silicon wafer is cut with a dicing blade or the like. At this time, a sealing tape is used for fixing the silicon wafer. In the present disclosure, this sealing tape for dicing (dicing tape) can be used as the sealing tape to suppress lateral widening of the opening of the above-described through hole. Consequently, the silicon substrate is processed very easily without increasing the number of steps. Therefore, the sealing tape can be peeled after the silicon substrates 1 are cut.

Figure 2A:
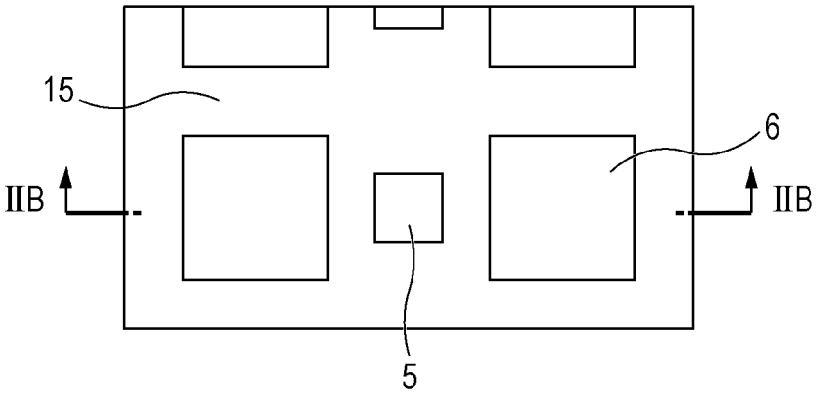
FIGS. 2A and 2B are diagrams showing an example of a silicon substrate processed.
Figure 2B:
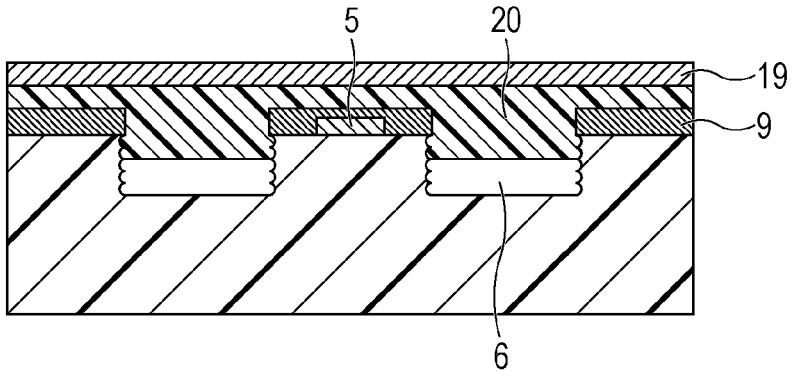

FIG. 2A shows a diagram of the silicon substrate 1 viewed from the upper surface of the first surface 2. FIG. 2 is a diagram showing the state before reactive ion etching is performed from the second surface 3 and showing an example in which the silicon substrate 1 is used as a substrate of a liquid ejection head. FIG. 2B is a sectional view of a cross section taken along a line IIB-IIB shown in FIG. 2A. An embodiment shown in FIGS. 2A and 2B has a configuration in which non-penetrated holes 6 are formed on both sides of an energy-generating element 5 and a liquid is supplied to the energy-generating element 5 from both directions. As shown in FIG. 2B, the sealing tape is stuck on the first surface 2 side and the adhesive layer 20 of the sealing tape is filled in at least part of the non-penetrated hole 6. The non-penetrated hole 6 is made into a through hole afterward and is used as a liquid supply port. That is, in order to improve the reliability of the liquid ejection head, in particular, it is necessary to suppress over etching from the non-penetrated hole 6 in the direction of the energy-generating element 5. A beam 15 is formed between the non-penetrated holes 6. In the case where a wiring (not shown in the drawing) to supply electric power to the energy-generating element 5 is arranged on the beam 15, it is also necessary to suppress widening of over etching in the direction of the beam 15. In this regard, the reliability of the liquid ejection head is improved by filling at least part of the non-penetrated hole 6 with the adhesive layer 20.

EXAMPLES

The present disclosure will be described below with reference to the examples.

Example 1

Figure 3A:
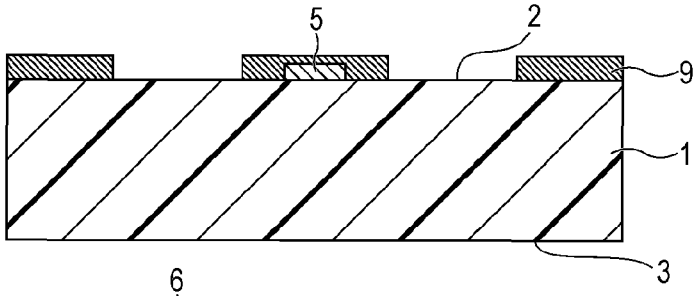
FIGS. 3A to 3F are diagrams showing an example of the method for processing a silicon substrate.

As shown in FIG. 3A, a silicon substrate 1 having a first surface 2 and a second surface 3 which was a surface opposite to the first surface 2 was provided. A silicon substrate having a thickness of 725.0 μm and exhibiting the crystal orientation of the first surface 2 and the second surface 3 of (100) was used as the silicon substrate 1. An energy-generating element 5 formed from TaSiN and an etching mask 9 formed from a positive photosensitive resin made from OFPR (produced by TOKYO OHKA KOGYO CO., LTD.) were disposed on the first surface 2 side of the silicon substrate 1. An opening was disposed in the etching mask 9.

Figure 3B:
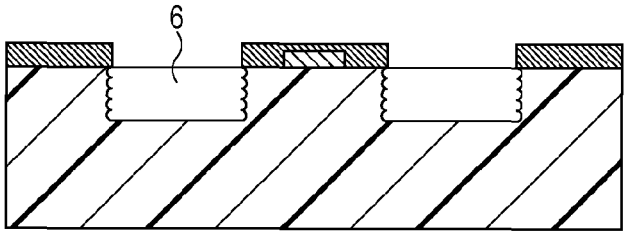

As shown in FIG. 3B, non-penetrated holes 6 were formed in the silicon substrate 1 by performing reactive ion etching from the first surface 2 of the silicon substrate 1 through the opening of the etching mask 9. The depths of the non-penetrated holes 6 from the first surface 2 were specified to be 225.0 μm. The width of one non-penetrated hole 6 in the direction perpendicular to the depth direction was specified to be 50.0 μm. The reactive ion etching was specified to be the bosch process by using an ICP etching apparatus (Model No.: 8E produced by Alcatel).

Figure 3C:
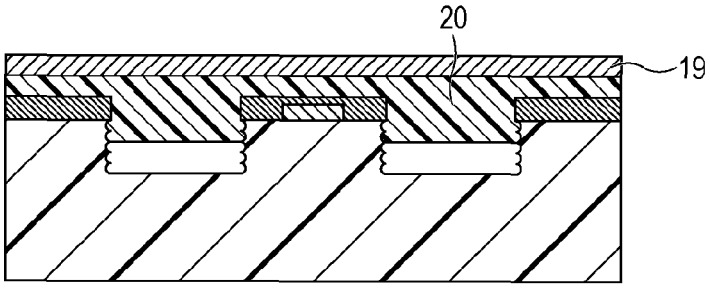

As shown in FIG. 3C, a sealing tape comprising a support member 19 and an adhesive layer 20 was stuck on the first surface 2 of the silicon substrate 1. The support member 19 was formed from polyolefin, and the adhesive layer was formed from a novolac resin. The novolac resin is not etched easily by the reactive ion etching as compared with the silicon substrate. In sticking of the sealing tape, the temperature of the adhesive layer was specified to be 120° C. by heating the whole sealing tape. The pressure in sticking of the sealing tape was specified to be constant at 0.5 MPa, and sticking was performed under the condition of 10 sec/cm. As a result, the adhesive layer 20 was filled in the non-penetrated hole 6. The length of the portion, which was filled in the non-penetrated hole, of the adhesive layer in the extension direction of the non-penetrated hole was 7.0 μm. When the silicon substrate 1 was viewed from above the first surface 2, the whole non-penetrated hole 6 was filled with the adhesive layer 20. Meanwhile, the amount of cutting of the adhesive layer 20 due to over etching was 0.1 μm/min or less.

Figure 3D:
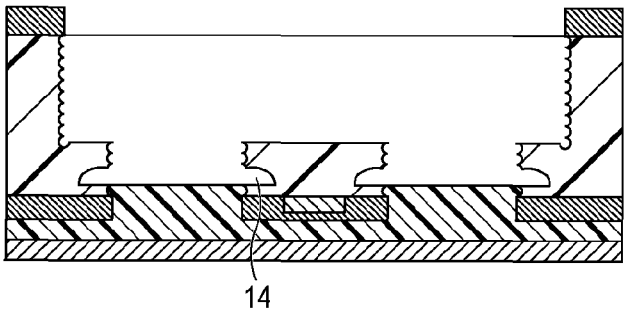

As shown in FIG. 3D, a mask was formed from the positive photosensitive resin made from OFPR (produced by TOKYO OHKA KOGYO CO., LTD.) on the second surface 3 of the silicon substrate 1. Subsequently, the reactive ion etching was performed from the second surface 3 of the silicon substrate 1 toward the first surface 2 side, and the reactive ion etching was allowed to reach the adhesive layer filled in the non-penetrated hole 6, so that the adhesive layer was exposed. The reactive ion etching was specified to be the bosch process by using the ICP etching apparatus (Model No.: 8E produced by Alcatel).

When the reactive ion etching reached the adhesive layer, the over etching occurred and a hole 14 was formed because the etching rate of the adhesive layer 20 was smaller than that of the silicon substrate 1. The length of the hole 14 was 0.2 μm in the direction perpendicular to the extension direction of the non-penetrated hole. In this regard, the hole 14 was formed at the position 6.8 μm apart from the first surface 2 of the silicon substrate 1 in the direction parallel to the extension direction of the non-penetrated hole.

Figure 3E:
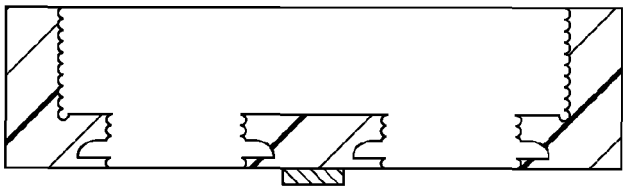

After the silicon substrate 1 was cut, as shown in FIG. 3E, the sealing tape was peeled from the silicon substrate 1. In this manner, a through hole was formed in the silicon substrate 1. According to examination of the inside of the through hole with a microscope, the adhesive layer of the sealing tape hardly remained. The etching masks on both surfaces of the silicon substrate 1 were peeled with a stripping solution.

Figure 3F:
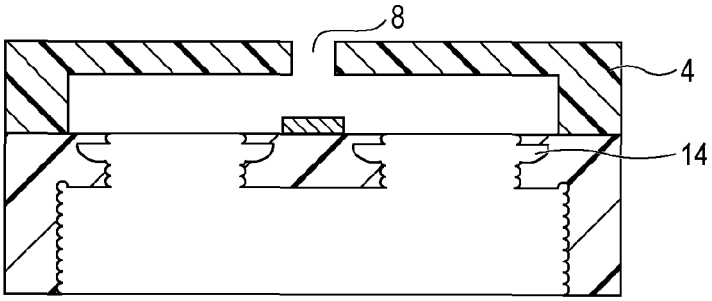

Finally, as shown in FIG. 3F, a member 4 to constitute a liquid ejection port 8 was formed on the first surface side, so that a liquid ejection head was obtained. As for the member 4, an epoxy resin was used as a negative photosensitive resin, exposure and development were performed and, thereby, the liquid ejection port 8 and a liquid flow passage were formed. The through hole formed in the silicon substrate 1 was used as a liquid supply port. The liquid supply port was configured to have independent supply ports on the first surface 2 side and a common supply port on the second surface 3 side. The holes 14 were formed in the side walls of the independent supply ports, where the positions were 6.8 μm apart from the first surface 2. The resulting liquid ejection head exhibited high reliability, where widening of the opening of the liquid supply port on the first surface 2 side of the silicon substrate 1 was suppressed.

Example 2

Figure 4A:
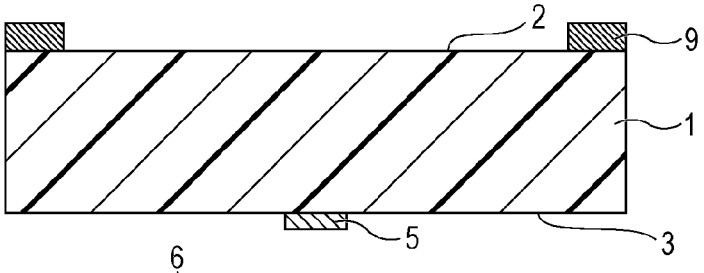
FIGS. 4A to 4F are diagrams showing an example of the method for processing a silicon substrate.
Figure 4B:
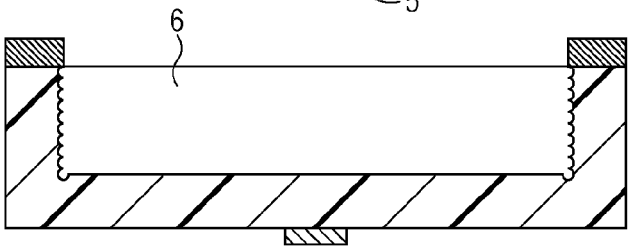
Figure 4C:
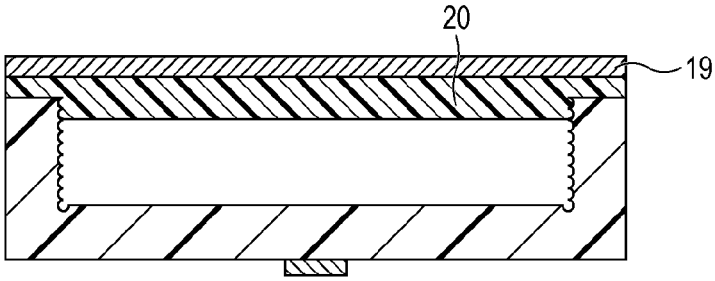
Figure 4D:
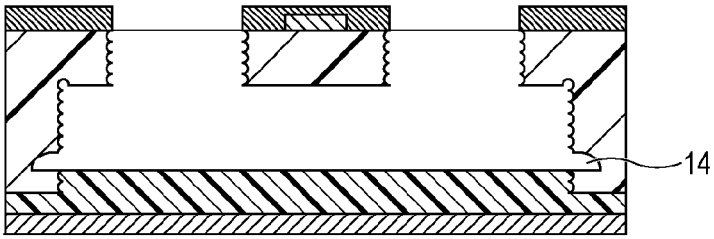
Figure 4E:
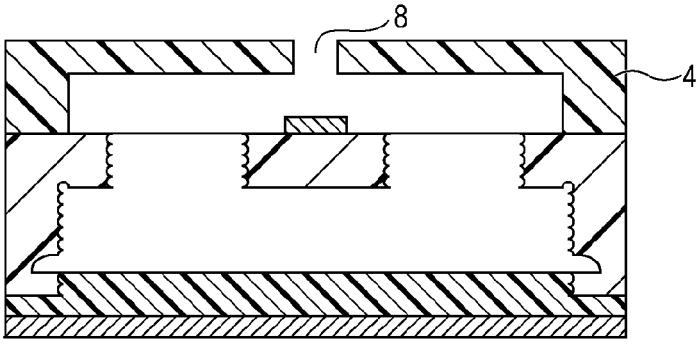

A liquid ejection head was produced by a method shown in FIGS. 4A to 4F. The manner was basically the same as the manner of Example 1, although an energy-generating element 5 was disposed on the second surface 3 side of a silicon substrate 1 and reactive ion etching to form a non-penetrated hole 6 was performed from a first surface 2, as shown in FIG. 4A. The depth of the non-penetrated hole 6 from the first surface 2 was specified to be 500.0 μm. The width of the non-penetrated hole 6 was specified to be 1,000.0 μm. The manner except those described above was the same as the manner in Example 1.

Figure 4F:
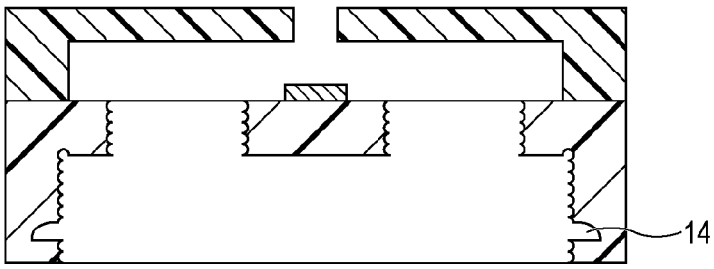

The resulting liquid ejection head was as shown in FIG. 4F. The liquid supply port was configured to have a common supply port on the first surface 2 side and independent supply ports on the second surface 3 side, as shown in FIG. 4F. The hole 14 was formed in the side wall of the common supply port, where the position was 718.2 μm apart from the first surface 2. In the resulting liquid ejection head, widening of the opening of the liquid supply port on the first surface 2 side of the silicon substrate 1 was suppressed and the hole 14 was formed at the position 718.2 μm apart from the first surface 2 in the portion of the common supply port rather than the position in the portion of the independent supply port. Therefore, a liquid ejection head exhibiting higher reliability was produced.

Example 3

A liquid ejection head was produced by a method shown in FIGS. 5A to 5F. The manner was basically the same as the manner of Example 2, although a non-penetrated hole 6 was formed by crystal anisotropic etching of the silicon substrate 1, where 25 percent by mass solution of TMAH was used as an etchant. Polyether amide was used for an etching mask 9. The depth of the non-penetrated hole 6 from the first surface 2 was specified to be 500.0 μm. The opening width of the non-penetrated hole 6 on the first surface 2 side was specified to be 1,000.0 μm. The manner except those described above was the same as the manner in Example 2.

Figure 5A:
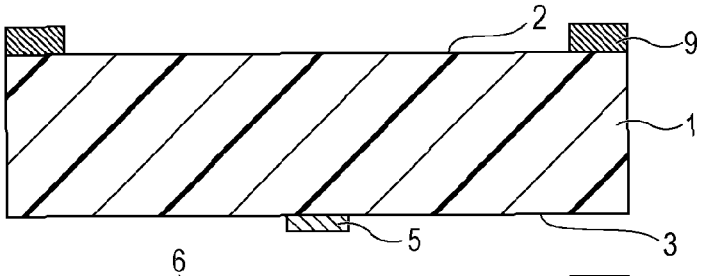
FIGS. 5A to 5F are diagrams showing an example of the method for processing a silicon substrate.
Figure 5B:
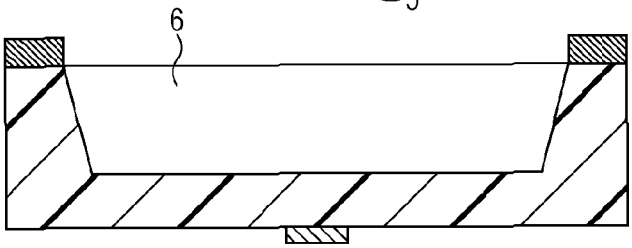
Figure 5C:
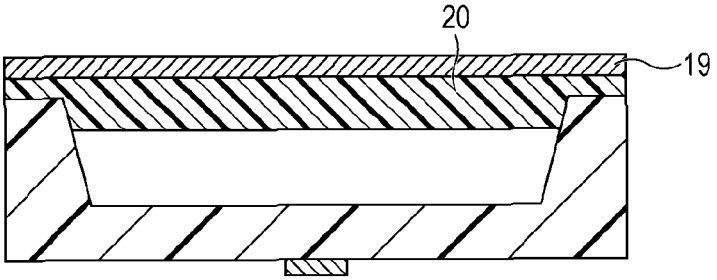
Figure 5D:
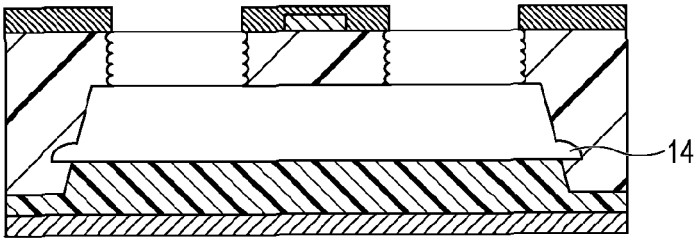
Figure 5E:
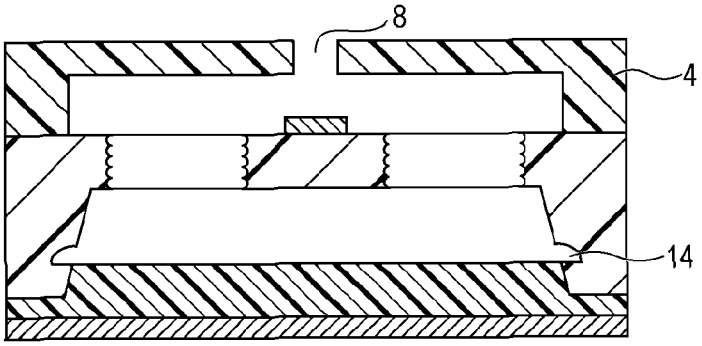
Figure 5F:
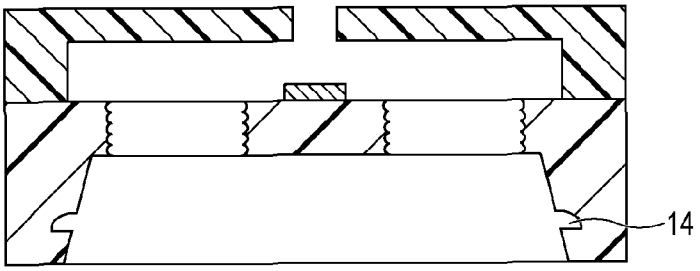

The resulting liquid ejection head was as shown in FIG. 5F. The liquid supply port was configured to have a common supply port on the first surface 2 side and independent supply ports on the second surface 3 side, as shown in FIG. 5F. The hole 14 was formed in the side wall of the common supply port, where the position was 718.2 μm apart from the first surface 2. The liquid ejection head obtained in Example 3 exhibited high reliability as with the liquid ejection head in Example 2.

According to the present disclosure, a method for processing a silicon substrate is provided, where lateral widening of the opening of the through hole due to over etching is suppressed easily even in the case where the through hole is formed by performing double-sided processing of the silicon substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-219641, filed Oct. 22, 2013, which is hereby incorporated by reference herein in its entirety.

What is claimed is:

1. A method for processing a silicon substrate to form a through hole in the silicon substrate, comprising the steps of:

providing a silicon substrate having a first surface and a second surface which is a surface opposite to the first surface;

forming a non-penetrating hole extending from the first surface of the silicon substrate toward the second surface side in the silicon substrate;

sticking a sealing tape comprising a support member and an adhesive layer on the first surface of the silicon substrate and filling a part of the non-penetrating hole with the adhesive layer, with space left inside the non-penetrating hole;

performing reactive ion etching from the second surface of the silicon substrate toward the first surface side to allow the reactive ion etching to reach the adhesive layer filled in the non-penetrating hole and to expose the adhesive layer; and peeling the sealing tape from the silicon substrate to form the through hole in the silicon substrate.

2. The method for processing a silicon substrate, according to claim 1, further comprising the step of cutting the silicon substrate, wherein in the cutting of the silicon substrate, the sealing tape is used as a dicing tape to fix the silicon substrate.

3. The method for processing a silicon substrate, according to claim 1, wherein the length of the portion, which is filled in the non-penetrating hole, of the adhesive layer in the extension direction of the non-penetrating hole is 3.0 μm or more.

4. The method for processing a silicon substrate, according to claim 1, wherein the length of the portion, which is filled in the non-penetrating hole, of the adhesive layer in the extension direction of the non-penetrating hole is 5.0 μm or more.

5. The method for processing a silicon substrate, according to claim 1, wherein the adhesive layer is filled in 90% or more of the non-penetrating hole when the first surface of the silicon substrate is viewed from above.

6. The method for processing a silicon substrate, according to claim 1, wherein the sealing tape is stuck on the first surface of the silicon substrate while the temperature of the adhesive layer is specified to be 70° C. or higher and 140° C. or lower.

7. The method for processing a silicon substrate, according to claim 1, wherein the sealing tape is applied on the first surface of the silicon substrate at a pressure of 0.1 MPa or more and 1.5 MPa or less.

8. The method for processing a silicon substrate, according to claim 1, wherein the non-penetrating hole is formed by reactive ion etching.

9. The method for processing a silicon substrate, according to claim 1, wherein the non-penetrating hole is formed by crystal anisotropic etching with an etchant.

10. The method for processing a silicon substrate, according to claim 1, wherein the reactive ion etching is performed by using a mask formed on the second surface of the silicon substrate.

11. A method for manufacturing a liquid ejection head comprising a silicon substrate, the method comprising the steps of:

providing a silicon substrate having a first surface and a second surface which is a surface opposite to the first surface;

forming a non-penetrating hole extending from the first surface of the silicon substrate toward the second surface side in the silicon substrate;

sticking a sealing tape comprising a support member and an adhesive layer on the first surface of the silicon substrate and filling a part of the non-penetrating hole with the adhesive layer, with space left inside the non-penetrating hole;

performing reactive ion etching from the second surface of the silicon substrate toward the first surface side to allow the reactive ion etching to reach the adhesive layer filled in the non-penetrating hole and to expose the adhesive layer; and peeling the sealing tape from the silicon substrate to form a through hole in the silicon substrate.

12. The method for manufacturing a liquid ejection head, according to claim 11, wherein the silicon substrate comprises an energy-generating element and the energy-generating element is disposed on the first surface side of the silicon substrate.

13. The method for manufacturing a liquid ejection head, according to claim 11, wherein the silicon substrate comprises an energy-generating element and the energy-generating element is disposed on the second surface side of the silicon substrate.

14. The method for manufacturing a liquid ejection head, according to claim 11, further comprising the step of cutting the silicon substrate, wherein in the cutting of the silicon substrate, the sealing tape is used as a dicing tape to fix the silicon substrate.

15. The method for manufacturing a liquid ejection head, according to claim 11, wherein the length of the portion, which is filled in the non-penetrating hole, of the adhesive layer in the extension direction of the non-penetrating hole is 3.0 μm or more.

16. The method for manufacturing a liquid ejection head, according to claim 11, wherein the length of the portion, which is filled in the non-penetrating hole, of the adhesive layer in the extension direction of the non-penetrating hole is 5.0 μm or more.

17. The method for manufacturing a liquid ejection head, according to claim 11, wherein the reactive ion etching is performed by using a mask formed on the second surface of the silicon substrate.

* * * * *